US005110690A

United States Patent [19]

Usui et al.

[11] Patent Number: 5,110,690

[45] Date of Patent: May 5, 1992

[54] SUBSTANTIALLY FLAT AND THIN STEEL BAND

[75] Inventors: Masayoshi Usui; Haruo Serizawa, both of Shizuoka, Japan

[73] Assignee: Usui Kokusai Sangyo Kabushiki Kaisha, Shizuoka, Japan

[21] Appl. No.: 652,368

[22] Filed: Feb. 7, 1991

Related U.S. Application Data

[63] Continuation of Ser. No. 390,041, Aug. 7, 1989, abandoned.

[30] Foreign Application Priority Data

Aug. 13, 1988 [JP] Japan ..... 63-201032

[51] Int. Cl.[5] ..... B32B 15/00

[52] U.S. Cl. ..... 428/678; 428/610; 428/941; 428/606; 428/607; 428/653

[58] Field of Search ..... 428/610, 941, 606, 607, 428/653, 678

[56] References Cited

U.S. PATENT DOCUMENTS 3,957,454 5/1976 Bessen ..... 428/941

4,071,659 1/1978 Santala ..... 428/941

4,853,360 8/1989 Hitachi ..... 502/439

FOREIGN PATENT DOCUMENTS 54-15536 6/1979 Japan ..... 428/941

OTHER PUBLICATIONS

Matsunaga et al., Applied Metallurgy Series: Stainless Steel Heat Resistant Alloys, Selichiro Ogawa, 1963, p. 106.

*Primary Examiner*—Deborah Yee

*Attorney, Agent, or Firm*—Lowe, Price, LeBlanc & Becker

[57] ABSTRACT

A nickel coating and an aluminum layer are formed in this order on an inexpensive thin steel sheet made of a low-carbon steel, a low-chromium steel or a low-nickel steel. Then the nickel- and aluminum-plated thin steel sheet is subjected to a diffusion penetration treatment to form a mutually diffused layer over the entire surface of the thin steel sheet, thus providing a thin steel band which is excellent in heat-resistance, corrosion-proofness at high temperature and rigidity.

14 Claims, 2 Drawing Sheets

SUBSTANTIALLY FLAT AND THIN STEEL BAND

This application is a continuation of application Ser. No. 07/390,041 filed Aug. 7, 1989, now abandoned.

BACKGROUND OF THE INVENTION

1. Field of the Invention

The present invention relates to a thin steel band which is heat-resistant and corrosion-proof at high temperature and has excellent workability. More particularly, the invention relates to a low-cost thin steel band which comprises a thin steel sheet and a mutually dispersed layer formed on the surface of the thin steel sheet by a simple method and composed of the components of the steel sheet, nickel and aluminum, which is excellent in workability and heat-resistivity and is easy to fuse.

2. Description of the Related Art

Thin steel bands have been used in a variety of fields, and for the particular field in which thin steel bands must be heat-resistant and corrosion-proof at high temperature, satisfactory steel bands have not been available by this time.

This particular field is exemplified by exhaust pipes, mufflers or the like of an automobile, and more specifically a metal-made carrier body for an exhaust gas cleaning catalyst. Hereinafter, the characteristics required for thin steel bands will be described in connection with a metal-made carrier body.

Metal-made carrier bodies of the above sort, which are adapted to carry thereon an exhaust gas cleaning catalyst, include those having a structure formed by laminating at least one sheet-like metal band and at least one corrugated metal band in layers (laminated type) or rolling them together (rolled type) into a multi-layered composite body so as to increase the carrying area per unit volume, namely, so as to increase as much as possible the effective area of contact between exhaust gas and the exhaust gas cleaning catalyst per unit volume and further and also so as to reduce the own weight of the metal-made carrier body to a maximum possible extent. As it is in the form of a honeycomb, this structure is hereinafter called "honeycomb core structure".

For example, a sheet-like metal band made of a heat-resistant thin steel sheet having a thickness of 0.1 mm or small and containing 20% of chromium and 5% of aluminum, and a corrugated band made from another thin steel sheet of the same type are superposed one over the other to have areas of contact therebetween. They are then rolled together spirally into a honeycomb core structure defining many network-patterned gas flow passages along a central axis thereof for allowing exhaust gas to pass therethrough. The honeycomb core structure is enclosed within a tubular metal casing which has a single-layer structure and opens in opposite ends thereof. The constituent members of the honeycomb core structure, i.e., the sheet-like band and corrugated band are put together into a vibration-proof structure. Namely, the sheet-like band and the corrugated band as well as the honeycomb core structure thus rolled and the metal casing are put together at the areas of contact therebetween by welding, brazing or the like.

In the honeycomb core structure, the characteristics required for thin steel bands as its constituent members are to have adequate heat-resistance and corrosion-proofness at high temperature, since an exhaust system of an automobile is subject to high temperature of usually 800° C. to 900° C. and very corrosive exhaust gas.

For other characteristics, the thin steel sheet (starting sheet) must be easy to roll and must have remarkable rigidity so as not to allow the wavy shape of the corruguated band to be deformed during the production of the honeycomb core structure.

For the preferable thin steel sheet to be used as a constituent member of the honeycomb core structure, a heat-resistant stainless steel additionally containing cobalt or rare earth elements such as cerium, yttrium, etc. in order to improve oxdation proofness (U.S. Pat. Nos. 4,661,169 and 4,414,023) have been proposed. When using as a constituent member of the honeycomb core structure, a thin sheet of such know steel must have a thickness of 0.05 mm (50 μm) and a width of 100 mm.

With the above required characteristics for the sheet-like and corrugated bands in view, an expensive heat-resistant steel such as a high-chromium steel, a high-nickel steel, etc. should be used; from a view point of cost, an inexpensive heat-resistant steel such as a low-carbon steel, a low-chromium steel, a low-nickel steel, etc. should be used.

However, if either the above-mentioned expensive heat-resistant steel or the above-mentioned inexpensive heat-resistant steel is used as the material for the constituent members, an adequately satisfactory honeycomb core structure cannot be obtained because of its poor workability and corrosion-resistance.

More specific problems are as follows:

i) If a heat-resistant steel containing chromium of 15% to 25% and aluminum of 2% to 5% is used, an adequately rigid corrugated band can be achieved, and especially there would be no deformation of the wave shape of the corrugated band during the production of the honeycomb core structure. Namely, when producing the laminated-type honeycomb core structure from a sheet-like steel band and a corrugated steel band, and also when inserting the honeycomb core structure in a tubular metal casing and fixing the honeycomb core structure on the tubular metal casing. However, this steel is very hard, and therefore a steel sheet is difficult to be rolled into a thin metal band for a honeycomb core structure. To obtain a steel band of a desired thickness, rolling and tempering must be repeated, which is laborious and time-consuming. Therefore it is expensive to manufacture a honeycomb core structure.

ii) In an attempt to obtain an inexpensive honeycomb core structure, it has been proposed to use a low-carbon steel containing less than 0.15% of carbon. A honeycomb core structure formed from the low-carbon steel is aluminized (forming solid solutions or alloying by dipping a honeycomb core structure in a molten aluminum liquid to cause mutual diffusion between the surface of the steel and the molten aluminum liquid). The resulting honeycomb core structure has no problem in corrosion-resistivity in an exhaust gas at a high temperature of 800° to 900° C. and also in cost of production. However, with this low-carbon steel, only a low-rigidity corrugated steel band can be obtained so that the wave shape of the corrugated steel band would be deformed markably when forming a honeycomb core structure.

Because of this markable deformation of the wave shape of the corrugated steel band, a desired height of the wave is difficult to achieve and therefore the mesh size of network-patterned gas flow passages in the honeycomb core structure would be reduced to cause disadvantages such as a pressure loss (lowering the efficiency of an internal combustion engine). Further, the contact between the sheet-like steel band and the corrugated steel band would change from spot contact to plane contact so that the amount to which an exhaust gas catalyst is to be carried on the carrier body can be reduced to impair the exhaust gas cleaning ability.

iii) Another attempt is to use an inexpensive heat-resistant steel such as a low-chromium steel, e.g. SUS410L (Cr content: 11 to 13.5%). This steel has a rigidity lower than the steel of i) above and higher than the steel of ii) above. Therefore, when forming a honeycomb core structure, the wave shape of the corrugated steel band would be deformed to a greater extent, compared with the steel of ii) above. The most significant problem of this steel is that it is inadequate in heat-resistivity and also in corrosion proofness. The same thing can be said when a low-nickel steel (nickel content: 3 to 6%) such as SUS201 and SUS202 are used as a heat-resistant steel.

SUMMARY OF THE INVENTION

It is therefore an object of the present invention to provide a thin steel band which is suitable for the constituent members of a metal-made carrier body, for an exhaust gas cleaning catalyst, in an automobile or the like.

Another object of the invention is to provide an inexpensive thin steel band which is produced from a low-cost and high-workability steel sheet as a starting material by forming a nickel coating on the surface of the steel sheet and then by dipping the coated steel sheet in a molten aluminum liquid and which is excellent in heat-resistance, corrosion-proofness at high temperature, rigidity and workability.

According to the present invention, there is provided a thin steel band comprising a thin steel sheet, and a mutually diffused layer formed on a surface of the thin steel sheet and composed of metal components of the steel sheet, nickel and aluminum, the mutually diffused layer being formed by forming a nickel coating on the steel sheet and then by dipping the coated steel sheet in a molten aluminum liquid.

The above and other objects, features and additional advantages of the present invention will become manifest to those versed in the art upon making reference to the detailed description and the accompanying drawings in which embodiments incorporating the principles of the present invention are shown by way of illustrative example.

DETAILED DESCRIPTION

Figure 1:
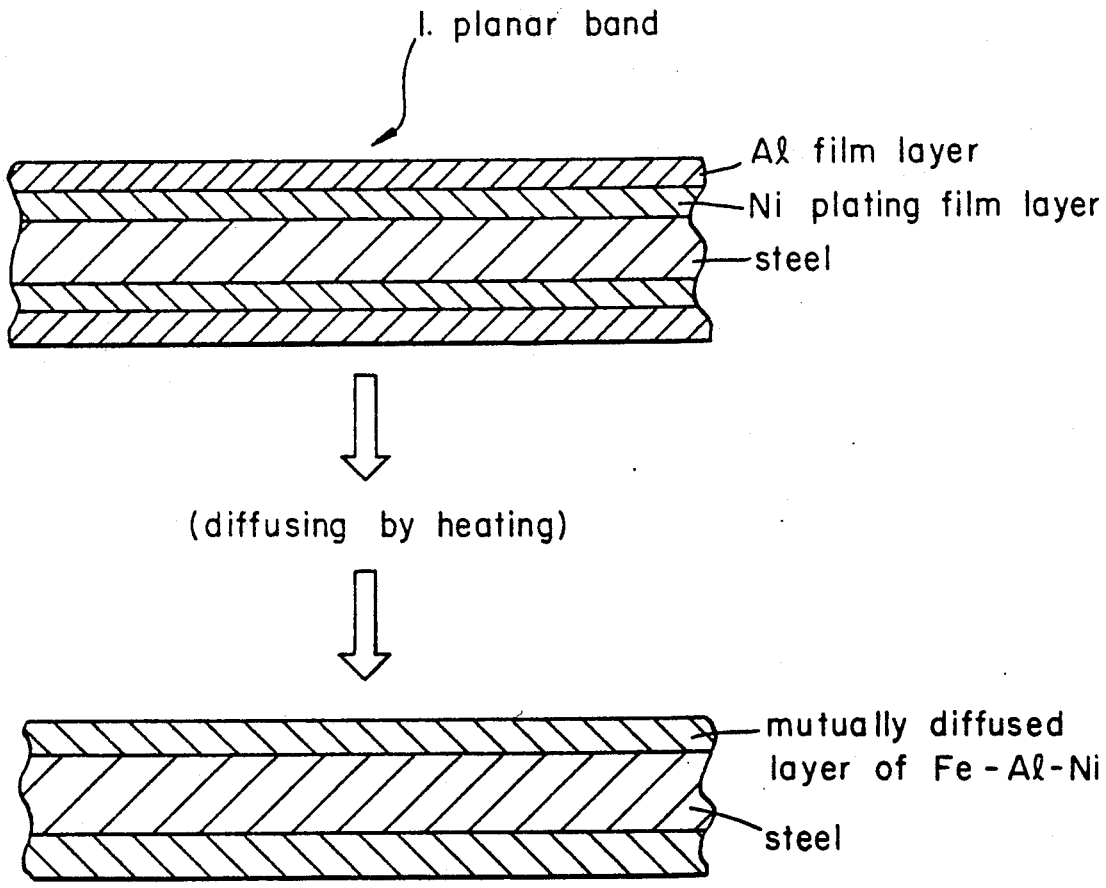
FIG. 1 is a schematic view illustrating the manner in which a mutually diffused layer such as of iron-aluminum-nickel is formed on a thin steel sheet according to the present invention.

A thin steel band to be used in the present invention may be, for example, a low-carbon steel containing 0.15% or less of carbon, a low-chromium heat-resistant steel containing 15% or less of chromium, a low-nickel steel, etc. which are inexpensive and have excellent workability. A steel sheet (starting sheet) is hot- or cold-rolled into a thin steel sheet having a thickness of preferably about 0.02 to 0.1 mm. For use in an exhaust pipe and a muffler, the preferable thickness of a thin steel sheet is usually 2.0 mm or less.

Then the resultant thin steel sheet is nickel-plated. For example, after having been degreased and washed, the thin steel sheet (thickness: 0.05 mm) is electroplated with nickel in a Watt bath (for example, the bath components are nickel sulfate of 350 g/l, nickel chloride of 50 g/l and boric acid of 45 g/l; pH: 4 to 4.6, bath temperature: 50° to 60° C.).

The thickness of a nickel coating may be set as desired; about 5 to 10 μm is sufficient for the thin steel bands of the honeycomb core structure constituting the above-mentioned metal-made carrier body. Nickel-plating may take place at midtime during the rolling, and the coated steel sheet may be rolled so as to have a desired thickness.

The forming of the nickel coating serves to assist in improving the heat-resistance of the thin steel sheet jointly with dipping the coated thin steel sheet in a molten aluminum liquid, as described below. This nickel coating also performs, as a brazing material, to join the thin steel sheets with firmness.

The aluminizing of the nickel-plated thin steel sheet will now be described. Immediately after having been cleaned by degreasing and washing and having been flux-treated to remove a surface oxide layer, the nickel-plated thin steel sheet is dipped in a molten aluminum liquid (bath) of about 700° C. After the aluminized thin steel sheet has been raised from the aluminum bath, excessive aluminum is removed by a blast of high pressure air and is then washed with hot water.

In this dipping treatment, an aluminum layer is formed on the entire surface of the thin steel sheet and, at the same time, aluminum of the aluminum layer is melted and diffused into the nickel coating due the heat of the dipping treatment to form an alloyed or solid-solution layer (hereinafter called "mutually diffused layer") such as of iron-nickel-aluminum (Fe-Ni-Al). The thickness of the aluminum layer is preferably 2 to 20 μm, compared to 5 to 15 μm of the nickel coating.

The formation of this nickel-aluminum mutually diffused layer is particularly significant to improve the metal-made carrier body both in the heat-resistance and the corrosion-proofness. Practically, the dipping treatment may be continued at a temperature of at most 800° C. for tens seconds, specifically 700° to 800° C. for at most 60 seconds, and preferably 720° to 760° C. for at most 30 seconds.

Alternatively, the aluminum layer may be formed by mechanical plating, evaporation or electroplaying, whereupon the resultant thin steel sheet may be subjected to diffusive penetration treatment to form on the surface of the steel-sheet an iron-aluminum-nickel mutually diffused layer which is heat-resistant and corrosion-proof and has an adequate hardness. This diffusive penetration treatment is illustrated in FIG. 1; as a matter of course, if the sheet-like band (thin steel sheet) is made of a low-chromium steel, the mutually diffused layer contains chromium.

According to the present invention, since the thin steel band is made from a steel sheet which is easy to roll and is inexpensive, it is possible to reduce the cost of rolling and annealing.

Having a mutually diffused layer composed of metal components of the steel sheet and nickel and aluminum, the thin steel band of the invention can be used for a variety of technical fields. In the illustrated embodiment, the thin steel band of the invention is used in a metal-made carrier body, for carrying thereon an exhaust gas cleaning catalyst, of an automobile or the like, as shown in FIGS. 2 and 3.

Figure 2:
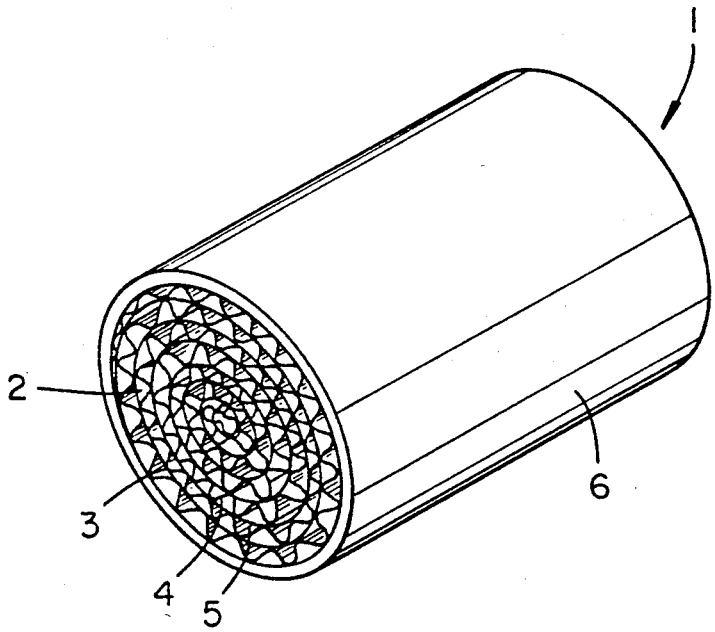
FIG. 2 is a perspective view of a rolled-type metal-made carrier body, for carrying thereon an exhaust gas cleaning catalyst, in which the constituent members of the carrier body are made of thin steel bands each embodying the invention.
Figure 3:
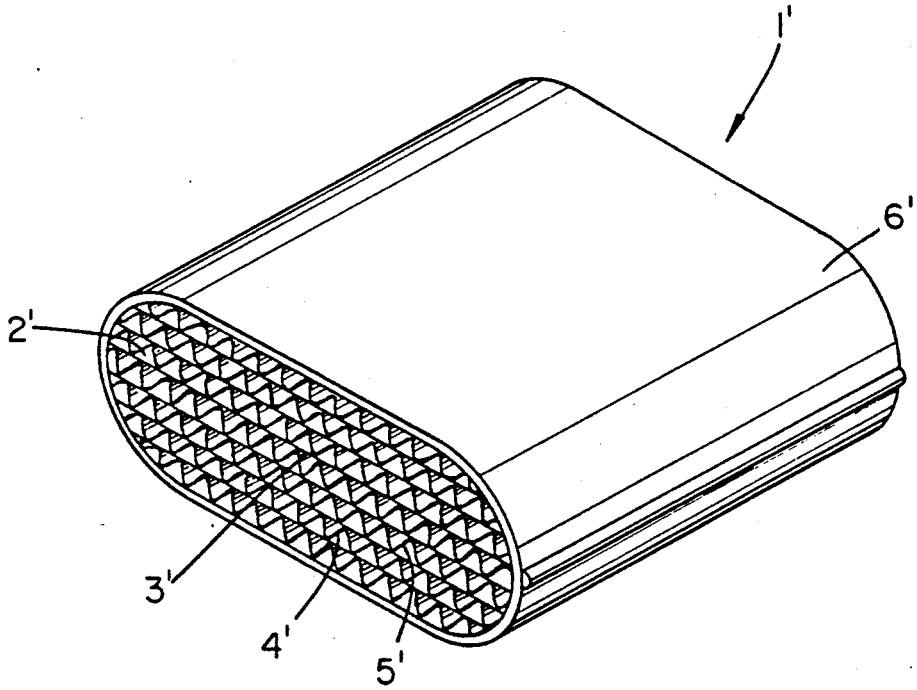
FIG. 3 is a view similar to FIG. 2, showing a laminated-type metal-made carrier body using thin steel bands of the invention.

FIGS. 2 and 3 are perspective views of metal-made carrier bodies 1, 1' for carrying thereon an exhaust gas cleaning catalyst.

The honeycomb core structure 2 of FIG. 2 is a rolled-type in which the sheet-like metal band 3 and the corrugated metal band 4 are rolled in a spiral form so as to have there mutual contact areas, and the honeycomb core structure 2' of FIG. 3 is a laminated-type in which the sheet-like metal band 3' and the corrugated metal band 4' are laminated one over the other. The honeycomb core structure 2, 2' has many network-patterned exhaust gas flow passages 5, 5' along the axis thereof. In each of FIGS. 2 and 3, the honeycomb core structure 2, 2' is enclosed in a tubular metal casing 6,6'.

Since it is manufactured from a steel sheet such as of a low-chromium steel which is easy to roll and is available at a relatively low cost, the thin steel band of the invention is economical.

According to the present invention, partly because a nickel coating is formed on the surface of the thin steel band and then an aluminum layer is formed over the nickel coating, and partly because these two layers are mutually diffused to form a mutually diffused layer containing nickel, such as of iron-nickel-aluminum, iron-chromium-aluminum, nickel-aluminum, these laminated layers make the individual thin steel bands heat-resistant and corrosion-proof at high temperature and adequately rigid.

Further, if the thin steel bands are to be joined together, their mutually diffused layers perform the function of brazing material so that a special or additional welding or brazing step can be omitted.

The present invention will now be described in detail by the following examples. It should be noted that the present invention is not limited to these illustrated examples.

EXAMPLE 1

A nickel coating of 6 μm thickness was formed, by electroplating, on opposite surfaces of a sheet-like band of a thin steel sheet made of a low-carbon steel (JIS G3141, SPCC) and having a thickness of 0.035 mm and a width of 74.5 mm. Then, the nickel-plated thin steel sheet was dipped in a mixed and dissolved chloride bath (composed of lithium chloride, potassium chloride, sodium chloride and sodium fluoride) to perform fluxing in order to remove an oxidized coating from the surface of the nickel-plated thin steel sheet.

After the fluxing treatment, the nickel-plated thin steel sheet was dipped in a molten aluminum bath of 730° C. and was pulled up therefrom. While the nickel-plated thin steel sheet was pulled upwardly, it was exposed to air blow and was wiped. As the oxidized coating was melted into the aluminum bath, the thickness of the nickel-plated layer was reduced to about 4 μm, and an aluminum layer having a thickness of 4 to 10 μm was formed on the nickel layer.

Subsequently, in a non-oxidative or reductive atmosphere in a heating furnace, nickel and aluminum were diffused and penetrated on the surface of the sheet-like metal band.

As a result, a mutually diffused layer of nickel and aluminum was formed on the surface of the sheet-like metal band. The resultant sheet-like metal band was heat-resistant and corrosion-proof and had a high degree of rigidity.

The sheet-like metal band was fed between forming gears to obtain a corrugated metal band in a wavy shape with longitudinal ridges spaced at pitches of 0.5 mm and having a height of 2.5 mm. Then the sheet-like band and the corrugated band were superposed one over the other to define areas of contact therebetween, whereupon these two bands were rolled together into a spiral form and were spot-welded at desired locations by a nickel brazing material to prevent them from loosening. As a result, a honeycomb core structure having an outer diameter of 90 mm was formed, during which time the wave shape of the corrugated metal band was not deformed. The honeycomb core structure may be enclosed in a tubular metal casing and may be brazed thereto according to need.

EXAMPLE 2

A nickel coating having a thickness of 5 μm was formed, by electroplating, on opposite surfaces of a sheet-metal band made of a thin steel sheet which is made of a low-chromium steel (JIS G4305 SUS 4101, chromium content: 11 to 13.5%) and which has a thickness of 0.04 mm and a width of 50.8 mm. Then the nickel-plated sheet-like metal band was dipped in a mixed and melted chloride bath to perform fluxing treatment.

After the fluxing treatment, the nickel-plated sheet-like metal band was dipped in a molten aluminum bath of a temperature of 720° C. and was pulled up therefrom. While the nickel-plated sheet-like band was pulled upwardly, it was exposed to air blow and was wiped. As the oxidized coating was melt into the aluminum bath, the thickness of the nickel-plated layer was reduced to about 2 to 3 μm, and an aluminum layer having a thickness of 4 to 10 μm was formed on the nickel layer. Subsequently, the diffusive penetration treatment same Example 1 was performed to form a honeycomb core structure having an outer diameter of 70 mm. While the sheet-like metal band and the corrugated metal band were rolled into a spiral form, the wave shape of the corrugated metal band would not be deformed. Thus a desired honeycomb core structure was obtained. Using this honeycomb core structure, a metal-made carrier body was produced in the same manner as Example 1.

On the surfaces of the flow passages of the metal-made carrier body obtained in each of Examples 1 and 2, slurry composed of active alumina (gamma-alumina) powder and alumina sol was applied, whereupon the slurry was heated at 600° C. to form and attach a catalyst-carrying layer on the flow passage surfaces. As a result of tests in which the carrier body was subjected to 50 cycles of alternately quickly cooling and heating as well as vibrations at a temperature of from room temperature to 700° C., no crack or separation was found either at the areas of contact or in the coating, showing excellent resistance to thermal impact. Further, this carrier body was excellent in heat-resistance and corrosion-proofness at high temperature.

Since aluminum based on the aluminum layer and the aluminum-containing mutually diffused layer is disposed on the surfaces of the thin steel sheet of the present invention, it is possible to increase the affinity between the two layers during the treatment of a wash coating liquid containing alumina as the primary component, which treatment is usually performed as a pre-step for carrying an exhaust gas cleaning catalyst. Accordingly, it is possible to stably form an alumina layer and aluminum whiskers, as a catalyst-carrying layer. Thus the metal-made carrier body can carry a ternary catalyst containing expensive platinum reliably.

What is claimed is:

1. A corrosion and heat resistant article which consists essentially of a substantially flat, thin steel substrate and a mutually diffused layer formed on a surface of said substrate, said mutually diffused layer consisting essentially of iron, nickel and aluminum, and being formed by providing a nickel coating on said steel substrate to form a coated steel substrate and then dipping said coated steel substrate in molten aluminum so as to cause mutual diffusion of iron from said steel substrate, nickel from said nickel coating and aluminum from said molten aluminum.

2. A corrosion and heat resistant article according to claim 1, wherein said thin steel substrate consists of low-carbon, steel, low-chrominum heat-resistant steel, or low-nickel heat-resistant steel.

3. A corrosion and heat resistant article according to claim 1, wherein said thin steel substrate consists of low-chromium heat-resistant steel containing less than about 15 weight percent chromium and said mutually diffused layer includes chromium which diffuses therein from said thin steel substrate.

4. A corrosion and heat resistant article according to claim 1, wherein said thin steel substrate has a thickness of from 0.02 to 2.0 mm.

5. A corrosion and heat resistant article according to claim 1, wherein the temperature of said molten aluminum is from 700° to 800° C.

6. A corrosion and heat resistant article according to claim 1, wherein said coated substrate is dipped in said molten aluminum for 60 seconds.

7. A corrosion and heat resistant article which consists essentially of a substantially flat, thin steel substrate and a mutually diffused layer formed on a surface of said substrate, said mutually diffused layer consisting essentially of iron, nickel and aluminum, and being formed by providing a nickel coating on said steel substrate to form a nickel coated steel substrate and then forming an aluminum coating on said nickel coated steel substrate to provide an aluminum-nickel coated steel substrate, and subjecting said aluminum-nickel coated steel substrate to a diffusive penetration treatment so as to cause mutual diffusion of iron from said steel substrate, nickel from said nickel coating and aluminum from said aluminum coating.

8. A corrosion and heat resistant article according to claim 7, wherein said thin steel substrate consists of low-carbon steel, low-chromium heat-resistant steel, or low-nickel heat-resistant steel.

9. A corrosion and heat resistant article according to claim 8, wherein said thin steel substrate consists of low-chromium heat-resistant steel containing less than about 15 weight percent chromium and said mutually diffused layer includes chromium which diffuses therein from said thin steel substrate.

10. A corrosion and heat resistant article according to claim 7, wherein said thin steel substrate has a thickness of from 0.02 to 2.0 mm.

11. A corrosion and heat resistant article according to claim 8, wherein the temperature of said diffusive penetration treatment is from 700° to 800° C.

12. A corrosion and heat resistant article according to claim 8, wherein said diffusive penetration treatment is continued for 60 seconds.

13. A corrosion and heat resistant article according to claim 1, wherein said substantially flat, thin steel substrate is subjected to a forming process after the mutual diffusion is complete.

14. A corrosion and heat resistant article according to claim 7, wherein said substantially flat, thin steel substrate is subjected to a forming process after the mutual diffusion is complete.

* * * * *